US005242741A

United States Patent [19]

Sugiyama et al.

[11] Patent Number: 5,242,741

[45] Date of Patent: Sep. 7, 1993

[54] BORONIZED SLIDING MATERIAL AND METHOD FOR PRODUCING THE SAME

[75] Inventors: Eiji Sugiyama; Motoshi Hayashi, both of Toyota, Japan

[73] Assignee: Taiho Kogyo Co., Ltd., Aichi, Japan

[21] Appl. No.: 964,467

[22] Filed: Oct. 21, 1992

Related U.S. Application Data

[63] Continuation of Ser. No. 578,922, Sep. 7, 1990, abandoned.

[30] Foreign Application Priority Data

Sep. 8, 1990 [JP] Japan ..... 1-233770

[51] Int. Cl.[5] ..... C23C 8/02; B22F 3/24

[52] U.S. Cl. ..... 428/213; 148/279; 148/330; 148/DIG. 34; 428/212; 428/307.3; 428/310.5; 428/315.7; 428/319.1; 428/457; 428/469

[58] Field of Search ..... 428/212, 213, 307.3, 428/310.5, 315.7, 704, 319.1, 457, 469; 148/279, 330, DIG. 34

[56] References Cited

U.S. PATENT DOCUMENTS

| | | | |
|---|---|---|---|
| 2,494,267 | 1/1950 | Schlesinger et al. | 148/279 |
| 3,673,005 | 6/1972 | Kunst et al. | 148/279 |
| 3,782,794 | 1/1974 | Chmura et al. | 308/193 |
| 3,870,569 | 3/1975 | Krzyminski | 148/279 |
| 3,915,757 | 10/1975 | Engel | 148/6 |
| 3,936,327 | 2/1976 | Fichtl et al. | 148/279 |
| 3,960,608 | 6/1976 | Cole | 148/279 |
| 3,994,750 | 11/1976 | Hehl | 148/279 |
| 4,232,094 | 11/1980 | Rhodes et al. | 428/627 |
| 4,289,545 | 9/1981 | Thevenot et al. | 148/279 |
| 4,539,053 | 9/1985 | Aves, Jr. | 148/279 |
| 4,637,837 | 1/1987 | Von Matuschka et al. | 148/279 |
| 4,943,485 | 7/1990 | Allam et al. | 428/457 |

FOREIGN PATENT DOCUMENTS

| | | |
|---|---|---|
| 7400021 | 1/1974 | France . |
| 7314938 | 5/1975 | Netherlands . |
| 0985140 | 1/1983 | U.S.S.R. . |
| 2108532 | 5/1983 | United Kingdom . |

OTHER PUBLICATIONS

Schmicreengorechnik, 1980, Aug., vol. 11, No. 88, pp. 238–240.

Technik Aus Polen.

*Primary Examiner*—A. A. Turner

*Attorney, Agent, or Firm*—Armstrong, Westerman, Hattori, McLeland & Naughton

[57] ABSTRACT

In the boronizing of a ferrous sintered material, the porosity of the surface to be boronized is reduced, while the interior of the ferrous sintered material is kept essentiall as sintered. The boron phase is selectively on the surface having a low porosity, resistance are attained.

6 Claims, 2 Drawing Sheets

BORONIZED SLIDING MATERIAL AND METHOD FOR PRODUCING THE SAME

This is a division of application Ser. No. 07/578,922 filed Sep. 7, 1990, now abandoned.

BACKGROUND OF THE INVENTION

1. Field of the Invention

The present invention relates to boronized sliding material and a method for producing the same. More particularly, the present invention relates to sintered sliding material, a part of which is boronized, and to a method for producing the same.

2. Description of Related Arts

Boronizing is widely applied to steel materials which have undergone rolling, forging, and casting, so as to improve the wear-resistance, oxidation-resistance, and corrosion-resistance thereof. While boronizing exhibits such improved properties, it has a drawback in that embrittlement occurs due to the hardness and brittleness of the borides. A very brittle layer of FeB is likely to form particularly on the treated surface. FeB readily cracks and embrittles, so that the material, on which FeB is formed, is inappropriate for use as sliding material.

The sintered material is usually used as is. The sintered material may occasionally be subjected to post-treatment, such as rolling, wire-drawing, staging, forging, rolling, sizing or coining. In coining, the sintered material is placed in a die and is rolled. Surface treatment of the sintered material is not usual.

Prior art of the surface treatment of the sintered material is now surveyed.

Material standard FN-0200-T stipulated in MplF (Metal Powder Institute Federation) specification relates to a case-hardenable material, which is characterized by addition of Ni and by a relatively high density in the range of from 7.2 to 7.6. In addition, SMF 2 stipulated in JPMA (Japan Powder Metallurgy Association) specification relates to material which is carburizable. Cu added in an amount of 3% or less makes the pores to disappear and hence creates the carburizing property.

Japanese Unexamined Patent Publication No. 60-21371 relates to a boronizing method. According to this method, a metallic container filled with Cr powder is compressed. The Cr powder is then sintered under such a condition that no pinholes are formed, and hence the sintered body has true density. Machining is then carried out to remove the container to obtain a wrought material. This wrought material having no pinholes, is then boronized. The method, therefore, is not the boronizing of sintered material.

Case-hardening or carburizing of sintered material has heretofore been known, whereby the sintered material as a whole is hardened. However, hardening a part of the surface of the sintered material, such as the inner surface of a tubular material, by boronizing has not been possible.

According to an experiment by the present inventors, the inner surface of a tubular sintered material was subjected to boronizing. The boronizing gas, which was in the generally generated amount, passed through the pores and leaked toward the outer surface of the tubular sintered material. Since boronizing in itself was impossible, the desired treated layer was evidently not formed on the inner surface. When the boronizing was carried out while generating a large amount of the boronizing gas, not only the surface but also the interior of the sintered body were boronized. In addition, a considerable amount of brittle FeB is formed on the surface of the pores which are present in the interior of the sintered body. The sintered body was therefore embrittled as a whole by the boronizing.

SUMMARY OF THE INVENTION

It is therefore an object of the present invention to provide a sintered sliding material having a boronized layer only on the desired surface, which material exhibits improved surface properties along with improved strength and load resistance.

It is another object of the present invention to provide a method for producing the sintered sliding material mentioned above.

In accordance with the objects of the present invention, there is provided a sintered ferrous sliding material comprising of a surface region comprising at least partially boride and having a first porosity lower than a second porosity of the inner region and of 5% or less, and of the porous inner region essentially free of boride, the boride being exposed on the surface region.

There is also provided a method for producing the sintered sliding material comprising the following steps: preparing a sintered ferrous material having porosity therein; applying pressure to the surface of the sintered material to be boronized, so as to decrease the porosity of the surface to 5% or less and lower than the porosity of the interior; and, bringing at least said pressure-applied surface or the sintered ferrous material with boronizing agent.

DESCRIPTION OF THE PREFERRED EMBODIMENTS

The mother materials to be boronized may be such various ferrous materials as sintered iron, and sintered ferrous alloy materials based on Fe-C, Fe-C-Cu, Fe-Ni, Fe-Ni-Cu, Fe-Mn, and Fe-C-Mn with or without S additive. The boronizing method which can be used in the present invention may be any one of the solid, liquid and gas methods, but the solid method is particularly preferred. The boride phase is thinly formed, by the boronizing, on the inner or outer surface of a tubular sintered body where the wear-resistance is to be imparted. The boride phase is also thinly formed, by the boronizing, on a surface of a sheet where the wear-resistance is to be imparted. The surface of the sliding material, which does not slide against the opposite member and hence is not required to be wear-resistant, should be desirably free of the boride, with the result that reduction of fatigue strength and the like due to the presence of the boride is lessened as much as possible.

The porosity of the surface region of the sliding material according to the present invention is lower than that of the interior region and is less than 5%. This is because, if the porosity of the surface region exceeds 5%, the boronizing gas leaks to the interior of the sintered body. When this happens, the desired surface is not boronized. Occasionally, the boronizing is possible, but even a deep part of the interior region or the interior region as a whole is boronized, with the result that brittle Fe8 is formed widely in the interior, and hence the sliding material embrittles. In addition, if the porosity of the surface is the same as that of the interior, stress is liable to concentrate on the boronized surface. In this case, the load resistance is impaired or the interior region is liable to embrittle depending upon the porosity.

The porosity of the surface region is preferably 2% or more for the following reasons. When the porosity of the surface region is in the range of from 2 to 5%, only a trace amount of the boronizing gas is leaked. This leads to the boronizing of the desired surface and also to enhancement of the boronizing speed at the initial stage because the boronizing gas fills the pores in the surface region. As the boronizing advances, expansion of the sintered material occurs and the pores of the surface region gradually diminish. The boride then fills the pores of the surface region. The leakage amount is therefore further reduced, so that the boronizing of the interior is further prevented. A trace amount of the boronizing gas, which is leaked from the surface region to the interior, is exhausted through the porous interior to the exterior of the sintered body. Note the high porosity of the interior facilitates the exhaustion of the leaked gas. When the porosity of the surface region is 2% or more, the pressure required for forming the surface region is advantageously lower than in the case of forming the surface region having porosity of less than 2%. In addition, the equipment for applying the pressure is uncomplicated and inexpensive.

The surface region has preferably a thickness of from 0.05 to 2 mm, more preferably from 0.1 to 1 mm, most preferably 0.2 to 0.6 mm. The best thickness is approximately 0.5 mm.

According to a preferred embodiment of the present invention, an intermediate region having porosity greater than 5 % but smaller than that of the interior region is formed between the two regions. The porosity of the intermediate region is adjusted by means of applying pressure to the sintered body. The porosity of the interior region remains unchanged by the pressure application. The porosity of the intermediate region in the proximity of the surface region and the interior region is preferably close to those of the two regions, respectively. The porosity of the intermediate region preferably gradually decreases from the one to the other of the above-mentioned ones. The intermediate region described above is advantageous from the following points of view, that is; the bonding strength between the surface region and the interior region is enhanced; absorbability of load is enhanced; gas is easily exhausted; and the sintered material is easily produced.

The intermediate and interior regions enable a higher load resistance to be attained than that attained only by the interior region. The intermediate region is preferably from 0.5 to 1.5 mm in thickness. The sum of the intermediate and surface regions is preferably from 2 mm or less. The boride phase is preferably formed only in the surface region but may be formed also in the surface part of the intermediate region in the case where the surface region is thin.

The porosity of the interior region is so high, preferably 6% or more, that it is not boronized. When the interior region is boronozied, the FeB layer is not removed by grinding, and hence the sliding material is brittle. Such sliding material exhibits a low load resistance, because the surface of the pores cracks when the sliding material is subjected to load. A non-boronized interior region having the high porosity as described above behaves as a cushion when the sliding material is subjected to load. The load resistance is therefore enhanced. When the porosity of the interior region is very low, the powder metallurgical conditions for obtaining a high sintered body become severe. On the other hand, when the porosity of the interior region becomes very high, for example 30% or more, the strength is so low as to make the sintered body inappropriate for the sliding member. The porosity value of the interior region described above indicates the average value of the values varying in the interior region from the border in contact with the surface region to the surface opposite to the boronized surface.

The distribution of porosity of the interior region should preferably be such that porosity is smaller at the part nearer the surface and greater at the more inner part. When the porosity of the interior region is great, the intermediate region is preferably formed so as to provide a homogeneous distribution of the strain in the interior region. The intermediate region has preferably a thickness of from 0.5 to 1.5 mm and has porosity between those of the surface region and the interior region, for example from 6 to 15%. The stress applied to a portion of the surface region is transmitted to the intermediate region bordering on the interior region. The stress is spread widely in the intermediate layer, because such layer is more dense than the surface region. The stress then transmitted to the interior region therefore does not locally concentrate.

When the load, to which the sliding material is subjected, is low, the boride phase may be formed such that it intrudes slightly, i.e., several tens of microns, into the interior region preferably, the thickness of the boride phase is controlled such that it is less than the surface region, and hence, the non-boronized surface region free of boride remains beneath the boronized surface region. In this case, the boride phase, the surface region without the boride phase (hereinafter referred to as "the intermediate layer"), and the interior region are successively formed beneath the surface of the sliding member. When such sliding member is subjected to load, the intermediate layer as a whole transmits the stress uniformly to the interior region, since the intermediate layer has a high density or a low porosity. That is, such intermediate layer has a high strength and, therefore, it has no weak portion where stress is liable to concentrate; hence the force is transmitted to the whole intermediate layer. Contrary to this, when the boride phase is in direct contact with the interior region, stress concentration is liable to take place at such contact point, which easily incurs local transmission of the stress to the interior region and destruction the sliding member. In this regard, the surface region is preferably thicker than the boride layer described in the following.

The boride layer is partly removed by a thickness of a view microns, i.e., the brittle FeB formed on the surface of the sliding member is removed, by means of grinding and the like.

The sintered material, which has been boronized and then treated as described above, is used as the sliding member. As is proposed in Japanese Patent Application No. 63-181671 (U.S. patent application Ser. No. 369,974, now U.S. Pat. No. 5,082,512) a dual phase of $Fe_2B$ and $Fe_3B$ may appear on the surface where the FeB phase has been removed. The thickness of the boride layer is preferably from 10 to 150 μm, more preferably from 30 to 100 μm. When the thickness of the boride phase is less than 10 μm, the wear-resistance is poor. On the other hand, when the thickness the boride layer exceeds 150 μm, a large amount of brittle FeB is formed, and shape distortion of the sliding member becomes likely to occur due to the boronizing. When shape distortion occurs, the interior of the boride layer is subjected to deformation, which makes the strength reduction likely to occur.

The sintered material, whose porosity of the surface part is different from that of the interior region, is produced by means of sintering by a conventional method to provide a sintered body having virtually uniform porosity throughout the body and then applying pressure to the sintered body. Specific methods for diminishing the pores are rolling, die-pressing, and die-forming with rotary discs. Any other method may be used. However, sizing is usually performed in order to preserve the life of jigs. The sizing is preferably carried out such that the size of a workpiece is decreased by approximately from 3 to 10%. When size reduction by sizing is less than 3%, the effects due to the size reduction are slight. On the other hand, working exceeding 10% size reduction is difficult. The working method of sizing is dependent upon the shape of the workpiece. For example, when a workpiece is tubular, the inner surface of the tubular workpiece is subjected to ironing by means of a die in the form of a mandrel tapered front end, so as to diminish the pores of the inner surface, or the outer surface of the tubular workpiece is subjected to ironing by means of a tubular die, so as to diminish the pores on the outer surface.

As described above, the sintered material can be boronized without incurring embrittlement due to borides, because the porosities of the surface region and the interior region are set as described above. The sintered material is partially boronized, with the result that the sintered sliding material having improved wear-resistance, oxidation-resistance, load-resistance, and fatigue-resistance is provided.

The present invention is described with reference to the examples and the drawings.

EXAMPLES

Sintered material was produced by sintering SMF3030 (Fe-C based sintered material) stipulated in JPMA specification for sintered material for mechanical and constructional use. The density of the sintered material was 7.0 g/cm$^3$, which corresponded to porosity of 16%. The shape of the sintered material was cylindrical, 20 mm in the inner diameter and 40 mm in the outer diameter. The inner surface of the tubular sintered material was subjected to the sizing to decrease the inner diameter to 19.2 mm, namely, the sizing dimension was 0.8 mm and the sizing ratio was 4%. Subsequently, the sintered material was boronized at 900° C. for 1 hour. The boronizing agent used was a powder mixture consisting of 3 to 20 parts of B4C, 50 to 80 parts of SiC, 10 to 30 parts of C, and from 0.5 to 7 parts of potassium borofluoride. This powder mixture was brought into contact with only the surface to be boronized. The boronizing was so carried out.

Figure 1:
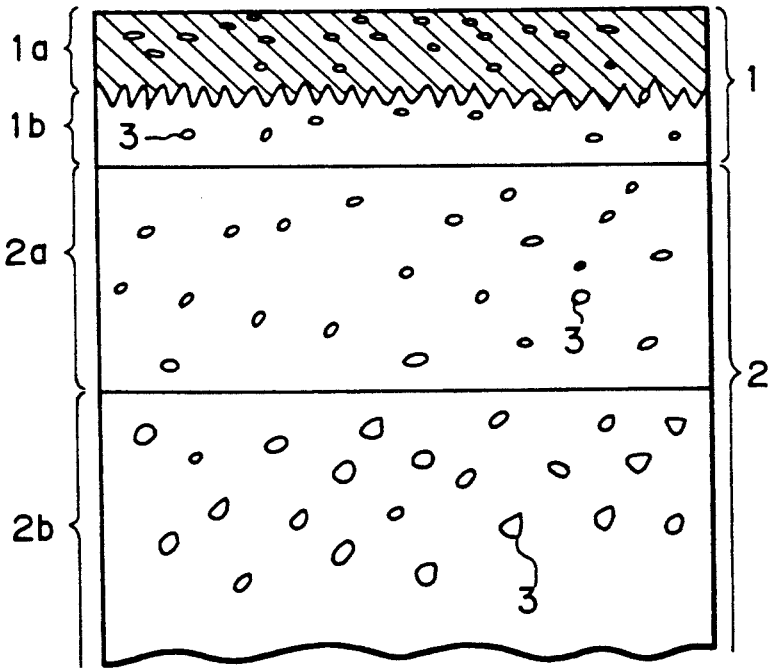
FIG. 1 is a schematic drawing of the boronized surface of sintered sliding material in the inventive Example 1.

Referring to FIG. 1, pores 3 and the boride layer 1*a* of the boronized surface are schematically illustrated. A part of the FeB phase formed on the top surface of the boronized material was removed by grinding and is not shown in FIG. 1. The surface region is denoted by 1 and has a thickness of 0.5 mm. The intermediate region is denoted by 2*a*. The border between the boride layer 1*a* and the mother material is in a zigzag pattern. The thickness of the boride layer herein is the average thickness measured at the average position of the convexities and concavities.

EXAMPLE

Figure 2:
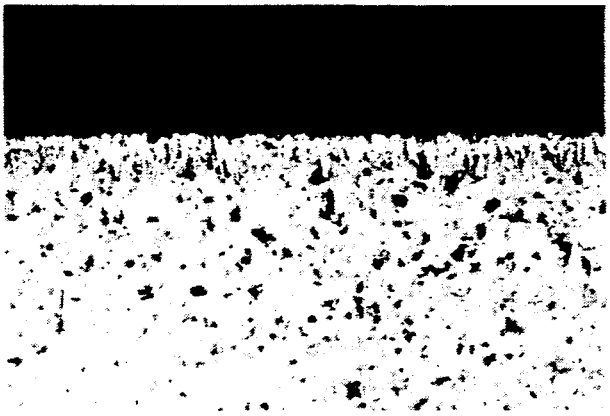
FIGS. 2 and 3 are the metal photographs of the boronized surface in the inventive Example 1.
Figure 3:
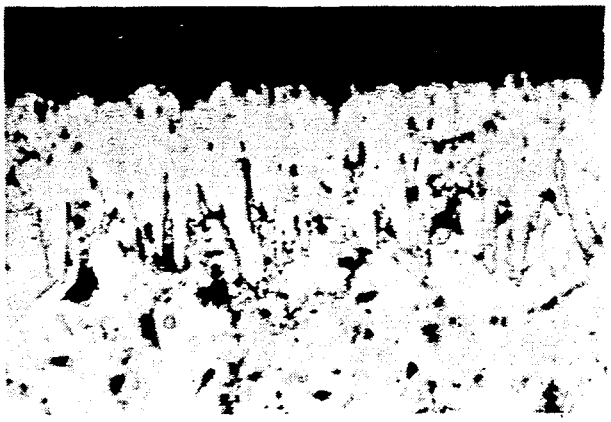

The surface region 1 (0.5 mm thick) had a porosity of 4%. The porosities of the interior region 2b and the intermediate region 2*a* (1.0 mm thick) were 16% and 7% respectively (at the center of the region 2*a*). The pores in the regions 1*a*, 1*b*, 2*a*, which were affected by sizing, were bonded or deformed and diminished to a thin elongated shape. As a result, the porosity in the surface region 1 and intermediate region 2*a* was decreased by the sizing. The average thickness of the boride layer 1*a* was 50 microns. Metal microscopic photographs of the boride layer are shown in FIG. 2 (magnification of 100) and in FIG. 3 (magnification of 400). As is clear from FIGS. 2 and 3, the boride layer is formed only on the surface of sintered material.

COMPARATIVE EXAMPLE

In this example, the ferrous sintered material having 15% of the porosity was not subjected to sizing but was directly boronized as a whole. The boronizing was carried out by the method of Example 1. The boride was formed on the surface of the sintered material and on the surface of the pores in the interior of the sintered material. The FeB was therefore present in the interior of the sintered material.

The wear resistance of the boronized materials according to Example 1 and Comparative Example was tested under the following condition.

Tester: a plate-journal friction tester
Speed: 4 m/sec
Load: 10 kg
Quantity of lubricating oil: 1 cc/min
Testing time: 1 Hr
Opposed material: high Si-Al
The results were as follows.

| | Coefficient of Friction | Depth of wear(μm) | |
|---|---|---|---|
| | | Test material | Opposed material |
| Example 1 | 0.08 | 0.5 | 0.5 |
| Comparative Example | 0.10 | 2.5 | 70 |

The load resistance was tested under the following condition.

Speed: 15 m/sec
Load: succesive increase by 40 kgf/10 min
Lubrication: oil-supply with a pad
Opposed material: high Si-Al The seizure load was 410 kg/cm$^2$ in Example 1, while the seizure load was 300 kg/cm$^2$ in Comparative Example.

EXAMPLE 2

In the present example, the porosity of the surface region 1 (0.5 mm thick) was 2%. The porosity of the interior region 2*b* was 16%. The porosity of the intermediate region 2*a* (1 mm thick) varied from 6 to 15%. The thickness of the boride layer 1*a* was 80 μm thick. The boronizing was carried out by the method described above. The boride layer was formed only on the inner surface of the tubular sintered material.

We claim:

1. A sintered ferrous sliding material having improved wear and load resistant properties comprising a surface region having a first porosity of from 2 to 5% and comprising a boride at least partially therein, and an interior region having a second porosity higher than the first porosity, the boride being exposed on the surface region and being essentially not formed in the interior region, wherein the second porosity is from 6 to 30%.

2. A sintered ferrous sliding material according to claim 1 further comprising an intermediate region between the surface region and the interior region having a third porosity greater than the first porosity and smaller than the second porosity.

3. A sintered ferrous sliding material according to claim 2, wherein the boride is essentially not formed in the intermediate region.

4. A sintered ferrous sliding material according to claim 3, wherein the surface region has a thickness of from 0.05 to 2 mm.

5. A sintered ferrous sliding material according to claim 3, wherein the intermediate region has a thickness of from 0.5 to 1.5 mm.

6. A sintered ferrous sliding material according to claim 5, wherein the boride is in the form of a layer having a thickness of from 10 to 150 μm.

* * * * *